US010669922B2

(12) United States Patent
Gonze et al.

(10) Patent No.: US 10,669,922 B2
(45) Date of Patent: Jun. 2, 2020

(54) SYSTEM AND METHOD FOR ADJUSTING THE RATE OF COOLANT FLOW THROUGH AN ENGINE BASED ON COOLANT PRESSURE

(71) Applicant: GM Global Technology Operations LLC, Detroit, MI (US)

(72) Inventors: Eugene V. Gonze, Pickney, MI (US); Sergio Quelhas, Ann Arbor, MI (US); Vijay A. Ramappan, Novi, MI (US); Michael J. Paratore, Jr., Howell, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 955 days.

(21) Appl. No.: 14/956,858

(22) Filed: Dec. 2, 2015

(65) Prior Publication Data

US 2017/0159546 A1 Jun. 8, 2017

(51) Int. Cl.

| | |
|---|---|
| ***F01P 7/16*** | (2006.01) |
| ***F01P 3/22*** | (2006.01) |
| ***F01P 5/10*** | (2006.01) |
| *F01P 7/14* | (2006.01) |

(52) U.S. Cl.

CPC ..... *F01P 7/164* (2013.01); *F01P 3/22* (2013.01); *F01P 5/10* (2013.01); *F01P 2007/146* (2013.01); *F01P 2025/06* (2013.01); *F01P 2025/08* (2013.01); *F01P 2060/12* (2013.01)

(58) Field of Classification Search

CPC ..... F01P 7/164; F01P 3/22; F01P 2007/146; F01P 2025/06; F01P 2025/08

USPC ..... 123/41.08

See application file for complete search history.

(56) References Cited

U.S. PATENT DOCUMENTS

| | | | | |
|---|---|---|---|---|
| 5,479,895 | A * | 1/1996 | Rusconi | F01P 5/14 123/198 D |
| 8,381,529 | B2 * | 2/2013 | Doyle | F02C 3/305 60/39.53 |
| 9,341,105 | B2 | 5/2016 | Jentz et al. | |
| 2014/0261254 | A1 | 9/2014 | Gonze et al. | |
| 2014/0356212 | A1 | 12/2014 | Barth et al. | |
| 2015/0066263 | A1 | 3/2015 | Abihana | |

(Continued)

FOREIGN PATENT DOCUMENTS

| | | |
|---|---|---|
| CN | 103362627 A | 10/2013 |
| CN | 104047700 A | 9/2014 |
| CN | 104214331 A | 12/2014 |

OTHER PUBLICATIONS

First Office Action for Chinese Application No. 201611035927.4 dated Aug. 30, 2018 with English language translation; 11 pages.

*Primary Examiner* — Stephen K Cronin
*Assistant Examiner* — Omar Morales

(57) ABSTRACT

A control system according to the principles of the present disclosure includes an estimated coolant flow module and at least one of a valve control module and a pump control module. The estimated coolant flow module estimates a rate of coolant flow through a cooling system for an engine based on a pressure of coolant in the cooling system and a speed of a coolant pump that circulates coolant through the cooling system. The valve control module controls the position of a coolant valve based on the estimated coolant flow rate. The pump control module controls the coolant pump speed based on the estimated coolant flow rate.

14 Claims, 4 Drawing Sheets

(56) References Cited

U.S. PATENT DOCUMENTS

| | | | | |
|---|---|---|---|---|
| 2016/0010537 | A1* | 1/2016 | Strode | G07C 5/0808<br>701/114 |
| 2017/0022881 | A1* | 1/2017 | Matsumoto | F01P 7/16 |

* cited by examiner

SYSTEM AND METHOD FOR ADJUSTING THE RATE OF COOLANT FLOW THROUGH AN ENGINE BASED ON COOLANT PRESSURE

FIELD

The present disclosure relates to internal combustion engines, and more specifically, to systems and methods for controlling the rate of coolant flow through an engine based on coolant pressure.

BACKGROUND

The background description provided here is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Internal combustion engines combust air and fuel within cylinders to generate drive torque. Combustion of air and fuel also generates heat and exhaust. Exhaust produced by an engine flows through an exhaust system before being expelled to atmosphere.

Engine cooling systems typically include a radiator that is connected to coolant channels within the engine. Engine coolant circulates through the coolant channels and the radiator. The engine coolant absorbs heat from the engine and carries the heat to the radiator. The radiator transfers heat from the engine coolant to air passing the radiator. The cooled engine coolant exiting the radiator is circulated back to the engine.

SUMMARY

A control system according to the principles of the present disclosure includes an estimated coolant flow module and at least one of a valve control module and a pump control module. The estimated coolant flow module estimates a rate of coolant flow through a cooling system for an engine based on a pressure of coolant in the cooling system and a speed of a coolant pump that circulates coolant through the cooling system. The valve control module controls the position of a coolant valve based on the estimated coolant flow rate. The pump control module controls the coolant pump speed based on the estimated coolant flow rate.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

In the drawings, reference numbers may be reused to identify similar and/or identical elements.

DETAILED DESCRIPTION

Engine cooling systems typically include a coolant pump and a coolant valve. The coolant pump circulates coolant through a cooling system for an engine. The coolant valve directs the coolant to different components of the cooling system and may be used to regulate coolant flow.

Engine control systems typically control the coolant pump and the coolant valve based on a function or mapping that relate a desired rate of coolant flow through the cooling system to a coolant pump speed and a coolant valve position. The desired coolant flow rate is adjusted to minimize a difference between a measured coolant temperature and a target coolant temperature.

Aging and architecture variation of the cooling system creates variation in the backpressure within the cooling system. If this backpressure variation is not captured in the function or mapping that relates the desired coolant flow rate to the coolant pump speed and the coolant valve position, the engine may overheat due to insufficient coolant flow. Thus, the function or mapping is typically more conservative than necessary by overestimating the coolant pump speed and coolant valve position required to achieve the desired coolant flow rate.

A control system and method according to the present disclosure estimates the actual rate of coolant flow through the cooling system based on a measured coolant pressure and the speed of the coolant pump. The control system and method then adjusts the desired coolant flow rate based on the estimated coolant flow rate to account for backpressure within the cooling system. Thus, the control system and method enables more precise control of the cooling system, which maximizes fuel efficiency and reduces warranty due to overuse of components such as the coolant pump.

Figure 1:
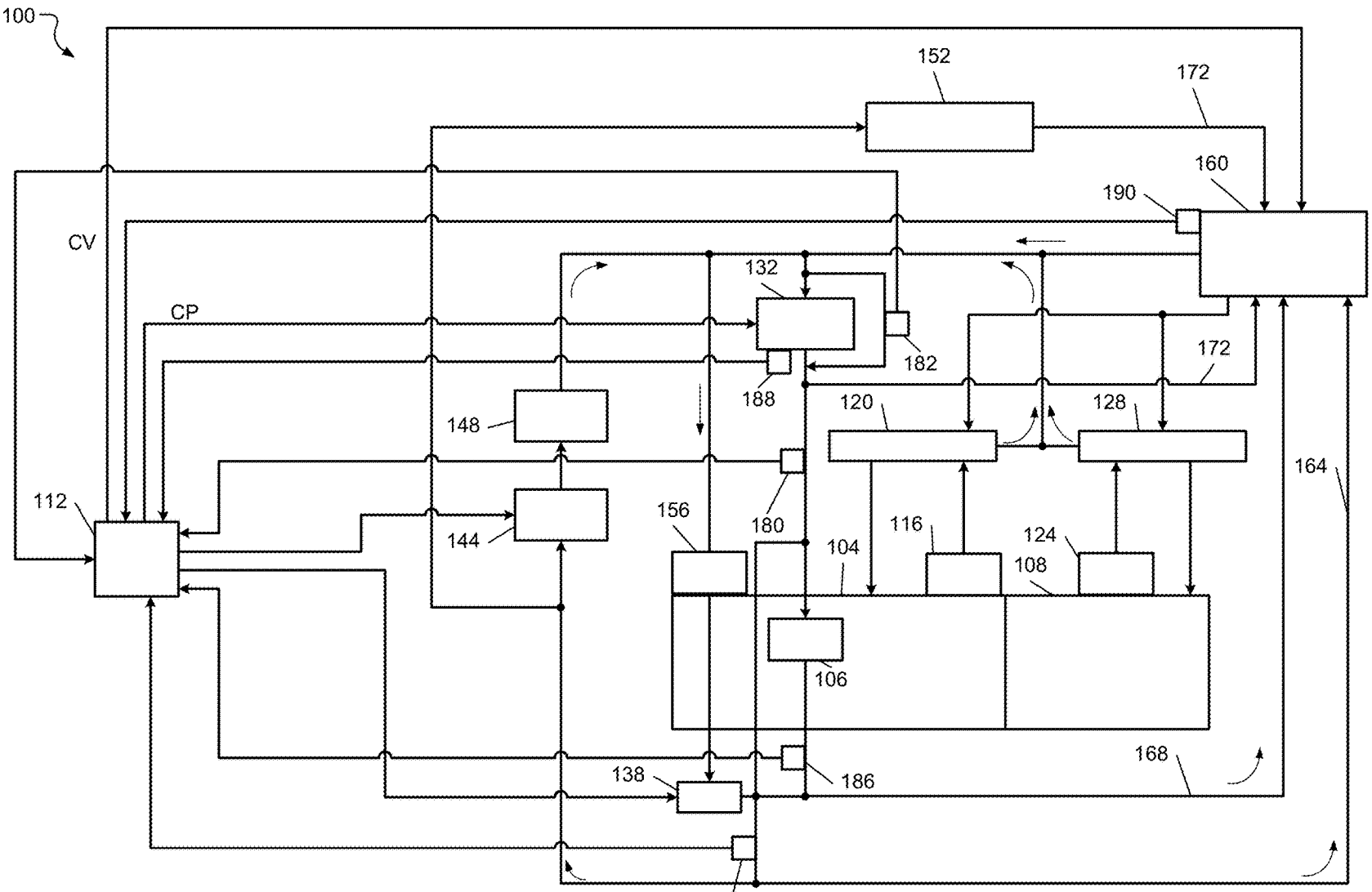
FIG. 1 is a functional block diagram of an example vehicle system according to the principles of the present disclosure.

Referring now to FIG. 1, an example vehicle system 100 includes an engine 104. The engine 104 combusts a mixture of air and fuel within cylinders to generate drive torque. An integrated exhaust manifold (IEM) 106 receives exhaust output from the cylinders and is integrated with a portion of the engine 104, such as a head portion of the engine 104.

The engine 104 outputs torque to a transmission 108. The transmission 108 transfers torque to one or more wheels of a vehicle via a driveline (not shown). An engine control module (ECM) 112 may control one or more engine actuators to regulate the torque output of the engine 104.

An engine oil pump 116 circulates engine oil through the engine 104 and a first heat exchanger 120. The first heat exchanger 120 may be referred to as an (engine) oil cooler or an oil heat exchanger (HEX). When the engine oil is cold, the first heat exchanger 120 may transfer heat to engine oil within the first heat exchanger 120 from coolant flowing through the first heat exchanger 120. When the engine oil is warm, the first heat exchanger 120 may transfer heat from the engine oil to coolant flowing through the first heat exchanger 120 and/or to air passing the first heat exchanger 120.

A transmission fluid pump 124 circulates transmission fluid through the transmission 108 and a second heat exchanger 128. The second heat exchanger 128 may be referred to as a transmission cooler or as a transmission heat exchanger. When the transmission fluid is cold, the second heat exchanger 128 may transfer heat to transmission fluid within the second heat exchanger 128 from coolant flowing through the second heat exchanger 128. When the transmission fluid is cold, the second heat exchanger 128 may transfer heat from the transmission fluid to coolant flowing through the second heat exchanger 128 and/or to air passing the second heat exchanger 128.

The engine 104 includes a plurality of channels through which engine coolant ("coolant") can flow. For example, the engine 104 may include one or more channels through the head portion of the engine 104, one or more channels through a block portion of the engine 104, and/or one or more channels through the IEM 106. The engine 104 may also include one or more other suitable coolant channels.

When a coolant pump 132 is on, the coolant pump 132 pumps coolant to various channels. While the coolant pump 132 is shown and will be discussed as an electric coolant pump, the coolant pump 132 may alternatively be mechanically driven (e.g., by the engine 104) or another suitable type of variable output coolant pump.

A block valve (BV) 138 may regulate coolant flow out of (and therefore through) the block portion of the engine 104. A heater valve 144 may regulate coolant flow to (and therefore through) a third heat exchanger 148. The third heat exchanger 148 may also be referred to as a heater core. Air may be circulated past the third heat exchanger 148, for example, to warm a passenger cabin of the vehicle.

Coolant output from the engine 104 also flows to a fourth heat exchanger 152. The fourth heat exchanger 152 may be referred to as a radiator. The fourth heat exchanger 152 transfers heat to air passing the fourth heat exchanger 152. A cooling fan (not shown) may be implemented to increase airflow passing the fourth heat exchanger 152.

Various types of engines may include one or more turbochargers, such as turbocharger 156. Coolant may be circulated through a portion of the turbocharger 156, for example, to cool the turbocharger 156.

A coolant valve 160 may include a multiple input, multiple output valve or one or more other suitable valves. The ECM 112 controls actuation of the coolant valve 160. The components of the vehicle system 100 through which coolant flows may collectively be referred to as a cooling system. Thus, the first heat exchanger 120, the second heat exchanger 128, the coolant pump 132, the block valve 138, the heater valve 144, the third heat exchanger 148, the coolant valve 160, and the coolant lines that extend between these components may collectively be referred to as the cooling system.

Figure 2:
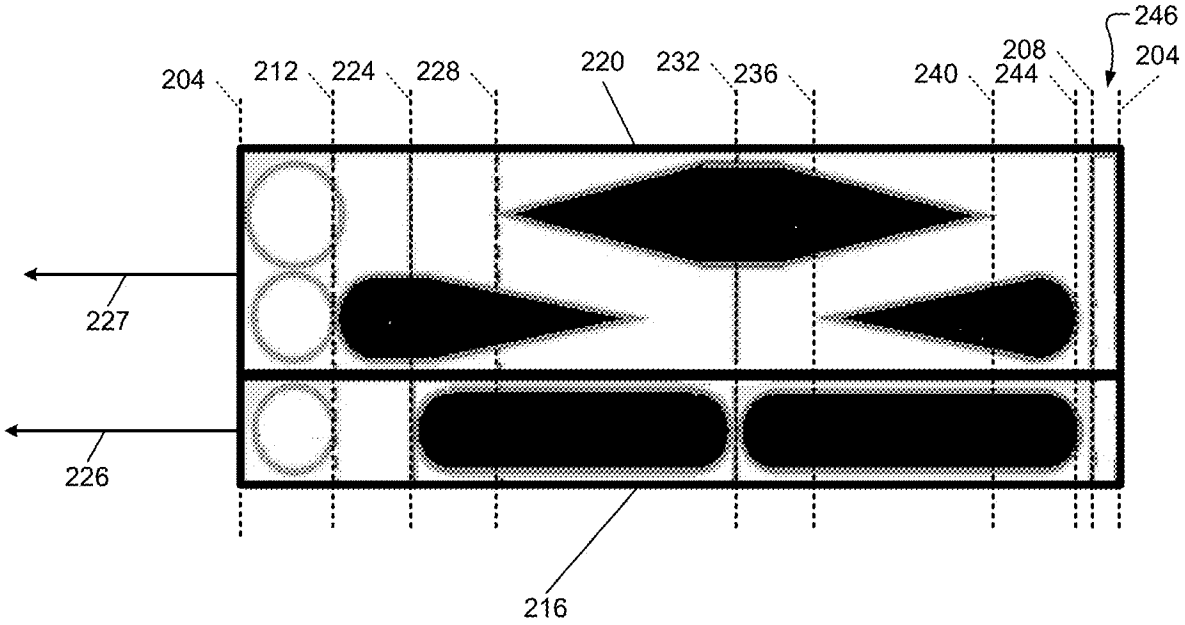
FIG. 2 is an example diagram illustrating coolant flow to and from a coolant valve at various positions of the coolant valve.

In various implementations, the coolant valve 160 may be partitioned and have two or more separate valve chambers. FIG. 2 illustrates coolant flow to and from an example of the coolant valve 160 where the coolant valve 160 includes two valve chambers. Although FIG. 2 depicts the coolant valve 160 as including two valve chambers, the coolant valve 160 may include more than two valve chambers.

Referring now to FIGS. 1 and 2, the coolant valve 160 can be rotated between two end positions 204 and 208. Although the coolant valve 160 may be spherical or cylindrical, FIG. 2 depicts the coolant valve 160 as flat for illustration purposes only. Since the coolant valve 160 is illustrated in this manner, the end position 204 appears twice in FIG. 2 even though the end position 204 is actually a single rotational position of the coolant valve 160. The end position 204 shown on the left side of FIG. 2 corresponds to a valve position of 0 degrees. The end position 204 shown on the right side of FIG. 2 corresponds to a valve position of 360 degrees.

When the coolant valve 160 is positioned between the end position 204 and a first position 212, coolant flow into a first chamber 216 is blocked, and coolant flow into a second chamber 220 is blocked. The coolant valve 160 outputs coolant from the first chamber 216 to the first heat exchanger 120 and the second heat exchanger 128 as indicated by 226. The coolant valve 160 outputs coolant from the second chamber 220 to the coolant pump 132 as indicated by 227.

When the coolant valve 160 is positioned between the first position 212 and a second position 224, coolant flow into the first chamber 216 is blocked and coolant output by the engine 104 flows into the second chamber 220 via a first coolant path 164. Coolant flow into the second chamber 220 from the fourth heat exchanger 152, however, is blocked. The ECM 112 may actuate the coolant valve 160 to between the first and second positions 212 and 224, for example, to warm the engine oil.

When the coolant valve 160 is positioned between the second position 224 and a third position 228, coolant output by the IEM 106 via a second coolant path 168 flows into the first chamber 216, coolant output by the engine 104 flows into the second chamber 220 via the first coolant path 164, and coolant flow into the second chamber 220 from the fourth heat exchanger 152 is blocked. The ECM 112 may actuate the coolant valve 160 to between the second and third positions 224 and 228, for example, to warm the engine oil and the transmission fluid.

When the coolant valve 160 is positioned between the third position 228 and a fourth position 232, coolant output by the IEM 106 via the second coolant path 168 flows into the first chamber 216, coolant output by the engine 104 flows into the second chamber 220 via the first coolant path 164, and coolant output by the fourth heat exchanger 152 flows into the second chamber 220. Coolant flow into the first chamber 216 from the coolant pump 132 via a third coolant path 172 is blocked when the coolant valve 160 is between the end position 204 and the fourth position 232. The ECM 112 may actuate the coolant valve 160 to between the third and fourth positions 228 and 232, for example, to warm the engine oil and the transmission fluid.

When the coolant valve 160 is positioned between the fourth position 232 and a fifth position 236, coolant output by the coolant pump 132 flows into the first chamber 216 via the third coolant path 172, coolant flow into the second chamber 220 via the first coolant path 164 is blocked, and coolant output by the fourth heat exchanger 152 flows into the second chamber 220. When the coolant valve 160 is positioned between the fifth position 236 and a sixth position 240, coolant output by the coolant pump 132 flows into the first chamber 216 via the third coolant path 172, coolant output by the engine 104 flows into the second chamber 220 via the first coolant path 164, and coolant output by the fourth heat exchanger 152 flows into the second chamber 220.

When the coolant valve 160 is positioned between the sixth position 240 and a seventh position 244, coolant output by the coolant pump 132 flows into the first chamber 216 via the third coolant path 172, coolant output by the engine 104 flows into the second chamber 220 via the first coolant path 164, and coolant flow from the fourth heat exchanger 152 into the second chamber 220 is blocked.

Coolant flow into the first chamber 216 from the IEM 106 via the second coolant path 168 is blocked when the coolant valve 160 is between the fourth position 232 and the seventh position 244. The ECM 112 may actuate the coolant valve 160 to between the fourth and seventh positions 232 and 244, for example, to cool the engine oil and the transmission fluid. Coolant flow into the first and second chambers 216 and 220 is blocked when the coolant valve 160 is positioned between the seventh position 244 and the end position 208. The ECM 112 may attempt to actuate the coolant valve 160 to a position within a predetermined range 246 defined between the end position 208 and the end position 204, for example, for performance of one or more diagnostics.

Referring back to FIG. 1, a coolant input temperature (CIT) sensor 180 measures a temperature of coolant input to (or on an inlet side of) the engine 104. A coolant input pressure (CIP) sensor 182 measures a pressure of coolant input to (or on an inlet side of) the engine 104. The coolant pump 132 may be disposed in a first coolant line, the coolant input pressure sensor 182 may be disposed in a second coolant line, and coolant may flow through the first and second coolant lines in parallel as shown.

A coolant output temperature (COT) sensor 184 measures a temperature of coolant output from (or on an outlet side of) the engine 104. An IEM coolant temperature sensor (ECT) 186 measures a temperature of coolant output from the IEM 106. A coolant pump speed (CPS) sensor 188 measures a speed of the coolant pump 132. A coolant valve position (CVP) sensor 190 measures a position of the coolant valve 160.

Output of the coolant pump 132 varies as the pressure of coolant input to the coolant pump 132 varies. For example, at a given speed of the coolant pump 132, the output of the coolant pump 132 increases as the pressure of coolant input to the coolant pump 132 increases, and vice versa. The position of the coolant valve 160 varies the pressure of coolant input to the coolant pump 132. The ECM 112 may control the speed of the coolant pump 132 based on the position of the coolant valve 160 to more accurately control the output of the coolant pump 132.

Figure 3:
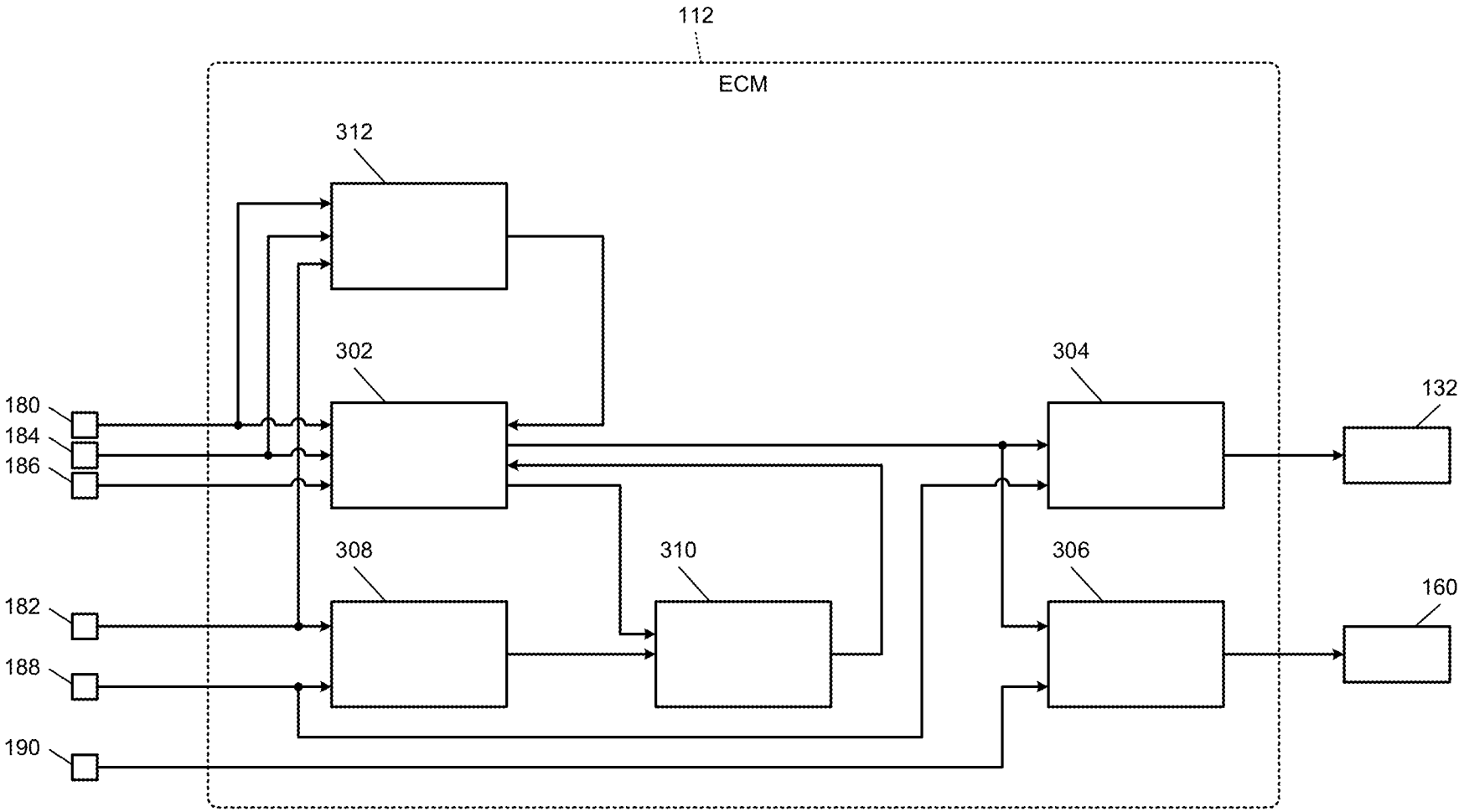
FIG. 3 is a functional block diagram of an example control system according to the principles of the present disclosure.

Referring now to FIG. 3, an example implementation of the ECM 112 includes a desired coolant flow module 302, a coolant pump control module 304, a coolant valve control module 306, an estimated coolant flow module 308, and a coolant flow correction module 310. The desired coolant flow module 302 determines a desired rate of coolant flow through the cooling system of the vehicle system 100. The desired coolant flow module 302 may determine the desired coolant flow rate based on the coolant input temperature from the CIT sensor 180, the coolant output temperature from the COT sensor 184, and/or the IEM coolant temperature from the ICT sensor 186. For example, the desired coolant flow module 302 may adjust the desired coolant flow rate to minimize a difference between (i) one or more of the coolant input temperature, the coolant output temperature, and the IEM coolant temperature, and (ii) a target coolant temperature. The desired coolant flow module 302 outputs the desired coolant flow rate.

The coolant pump control module 304 controls the speed of the coolant pump 132 based on the desired coolant flow rate. The coolant pump control module 304 may determine a desired pump speed based on the desired coolant flow rate. The coolant pump control module 304 may output a signal instructing the coolant pump 132 to achieve the desired pump speed. Alternatively, the coolant pump control module 304 may adjust the output of the coolant pump 132 to minimize a difference between the coolant pump speed measured by the CPS sensor 188 and the desired pump speed. Thus, the signal output by the coolant pump control module 304 may indicate a desired pump capacity.

The coolant valve control module 306 controls the position of the coolant valve 160 based on the desired coolant flow rate. The coolant valve control module 306 may determine a desired valve position based on the desired coolant flow rate and output a signal instructing the coolant valve 160 to achieve the desired valve position. The coolant valve control module 306 may control the position of the coolant valve 160 using closed-loop control. For example, coolant valve control module 306 may adjust the desired valve position to minimize a difference between an unadjusted value of the desired valve position and the coolant valve position measured by the CVP sensor 190.

The coolant pump control module 304 may control the coolant pump speed based on a first predetermined relationship between the coolant pump speed, the coolant valve position, and the desired coolant flow rate. The first predetermined relationship may be embodied in a lookup table and/or an equation. The coolant valve position used by the coolant pump control module 304 to control the coolant pump speed may be the coolant valve position measured by the CVP sensor 190 or the desired coolant valve position output by the coolant valve control module 306.

The coolant valve control module 306 may control the coolant valve position based on a second predetermined relationship between the coolant pump speed, the coolant valve position, and the desired coolant flow rate. The second predetermined relationship may be embodied in a lookup table and/or an equation. The coolant pump speed used by the coolant valve control module 306 to control the coolant valve position may be the coolant pump speed measured by the CPS sensor 188 or the desired coolant pump speed output by the coolant pump control module 304. The second predetermined relationship may be the same as the first predetermined relationship.

The estimated coolant flow module 308 estimates the rate of coolant flow through the cooling system based on, for example, the coolant input pressure measured by the CIP sensor 182 and the coolant pump speed measured by the CPS sensor 188. For example, the estimated coolant flow module 308 may estimate the rate of coolant flow through the cooling system based on a predetermined relationship between the coolant pump speed, the coolant input pressure, and the coolant flow. This predetermined relationship may be embodied in a lookup table and/or an equation. The estimated coolant flow module 308 outputs the estimated coolant flow rate.

The coolant flow correction module 310 determines a coolant flow correction factor based on a difference between the estimated coolant flow rate and the desired coolant flow rate. The coolant flow correction factor may be a multiplier or an offset that is applied to the desired coolant flow rate. The coolant flow correction module 310 may increase the coolant flow correction factor when the desired coolant flow rate is greater than the estimated coolant flow rate. The coolant flow correction module 310 may decrease the coolant flow correction factor when the desired coolant flow rate is less than or equal to the estimated coolant flow rate. The amount by which the coolant flow correction module 310 increases or decreases the coolant flow correction factor may be based on the difference between the estimated coolant flow rate and the desired coolant flow rate.

In one example, the coolant flow correction module 310 determines the coolant flow correction factor based on a previous value of the coolant flow correction factor and a correction factor adjustment value. The coolant flow correction module 310 may add the correction factor adjustment value to the previous value of the coolant flow correction factor to obtain the coolant flow correction factor when the desired coolant flow rate is greater than the estimated coolant flow rate. The coolant flow correction module 310 may subtract the correction factor adjustment value from the previous value of the coolant flow correction factor to obtain the coolant flow correction factor when the desired coolant flow rate is less than or equal to the estimated coolant flow rate. The coolant flow correction module 310 may determine the correction factor adjustment value based on the difference between the estimated coolant flow rate and the desired coolant flow rate.

The desired coolant flow module 302 may adjust the desired coolant flow rate based on the coolant flow correction factor. If the coolant flow correction factor is a multiplier, the desired coolant flow module 302 may multiply the desired coolant flow rate by the coolant flow correction factor. If the coolant flow correction factor is an offset, the desired coolant flow module 302 may add the coolant flow correction factor to the desired coolant flow rate. The coolant pump control module 304 and the coolant valve control module 306 may control the coolant pump speed and the coolant valve position, respectively, based on the desired coolant flow rate as adjusted.

The example implementation of the ECM 112 shown in FIG. 3 also includes a temperature correction module 312. The temperature correction module 312 determines whether coolant flowing through the vehicle system 100 is boiling and determines a temperature correction factor based on whether the coolant is boiling. The temperature correction module 312 may determine whether the coolant is boiling based on the cooling input pressure measured by the CIP sensor 182 and a measured coolant temperature. The measured coolant temperature may include the coolant input temperature measured by the CIT sensor 180, the coolant output temperature measured by the COT sensor 184, and/or the IEM coolant temperature measured by the ICT sensor 186.

The desired coolant flow module 302 may determine the desired coolant flow rate based on one or more of the measured coolant temperatures discussed above and the temperature correction factor. In one example, the desired coolant flow module 302 determines the desired coolant flow rate based on a sum of the temperature correction factor and a difference between the coolant input temperature and the coolant output temperature. The temperature correction module 312 may set the temperature correction factor to a negative value when the coolant is boiling, and set the temperature correction factor to zero when the coolant is not boiling. Thus, when the coolant is boiling, the temperature correction module 312 may adjust (decrease) the difference between the coolant input temperature and the coolant output temperature, and this difference as adjusted may be used to determine the desired coolant flow rate.

Figure 4:
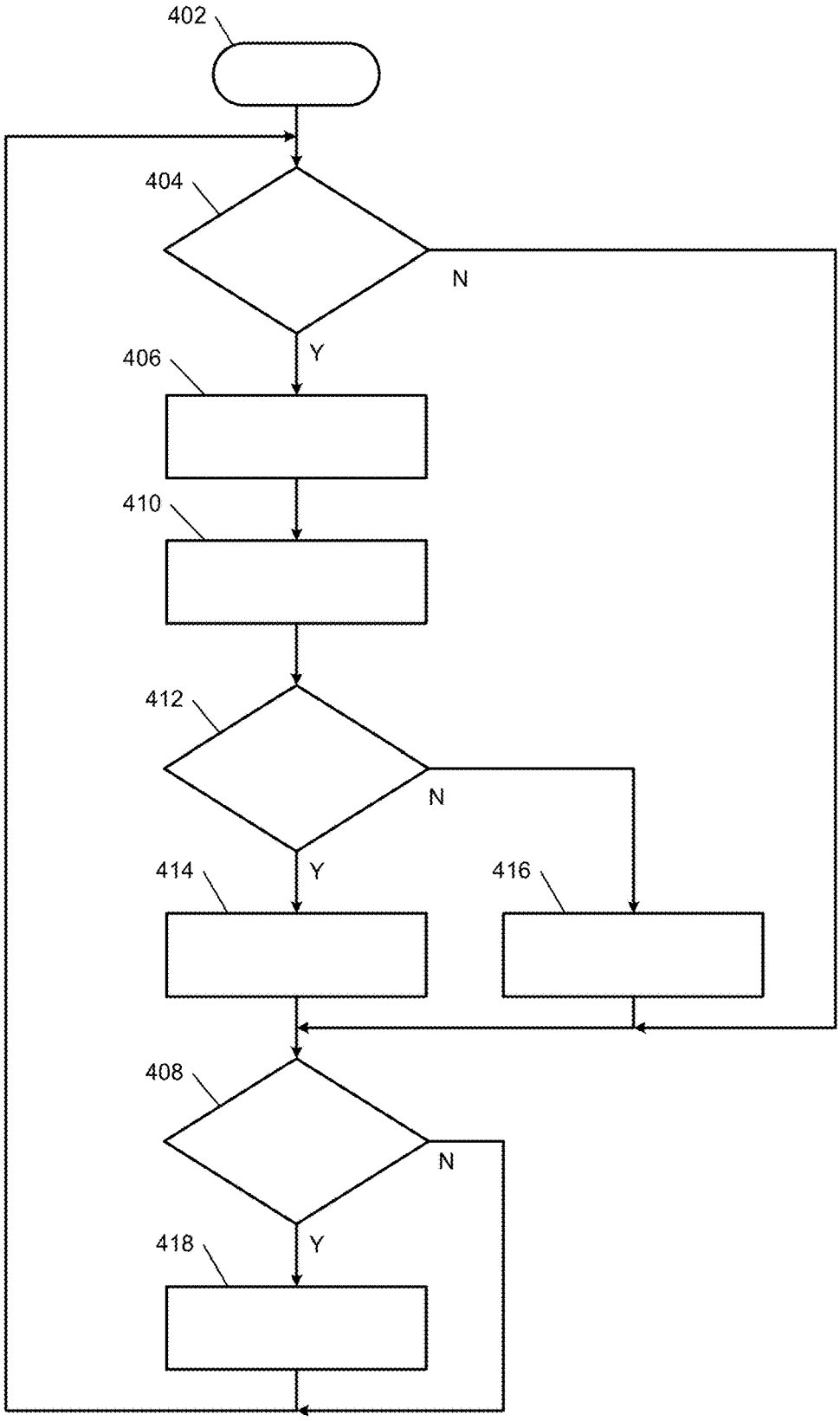
FIG. 4 is a flowchart illustrating an example control method according to the principles of the present disclosure.

Referring now to FIG. 4, an example method for controlling the rate of coolant flow through an engine based on coolant pressure begins at 402. The method is described in the context of the modules of FIG. 3. However, the particular modules that perform the steps of the method may be different than the modules mentioned below and/or the method may be implemented apart from the modules of FIG. 3.

The 404, the desired coolant flow module 302 determines whether a measured coolant temperature is greater than a first temperature. The measured coolant temperature may include the coolant input temperature measured by the CIT sensor 180, the coolant output temperature measured by the COT sensor 184, and/or the IEM coolant temperature measured by the ICT sensor 186. The first temperature may be a predetermined temperature (e.g., zero degrees Celsius) and may be a minimum value of the measured coolant temperature during normal operating conditions. If the measured temperature is greater than the first temperature, the method continues at 406. Otherwise, the method continues at 408.

At 406, the desired coolant flow module 302 determines the desired rate of coolant flow through the cooling system of the vehicle system 100. The desired coolant flow module 302 may determine the desired coolant flow rate based on the measured coolant temperature. For example, the desired coolant flow module 302 may adjust the desired coolant flow rate to minimize a difference between the measured coolant temperature and a desired coolant temperature. At 410, the estimated coolant flow module 308 estimates the actual rate of coolant flow through the cooling system of the vehicle system 100. The estimated coolant flow module 308 may estimate the actual coolant flow rate based on the coolant input pressure measured by the CIP sensor 182 and the coolant pump speed measured by the CPS sensor 188 as described above.

At 412, the coolant flow correction module 310 determines whether the desired coolant flow rate is greater than the actual coolant flow rate. If the desired coolant flow rate is greater than the actual coolant flow rate, the method continues at 414. Otherwise, the method continues at 416.

At 414, the coolant flow correction module 310 increases the coolant flow correction factor. The amount by which the coolant flow correction module 310 increases the coolant flow correction factor may be determined based on a difference between the coolant input temperature and the coolant output temperature. In one example, the coolant flow correction module 310 determines a correction factor adjustment value based on the difference between the coolant input temperature and the coolant output temperature. The coolant flow correction module 310 then determines the coolant flow correction factor by adding the correction factor adjustment value to a previous value of the coolant flow correction factor.

At 416, the coolant flow correction module 310 decreases the coolant flow correction factor. The amount by which the coolant flow correction module 310 decreases the coolant flow correction factor may be determined based on the difference between the coolant input temperature and the coolant output temperature. In one example, the coolant flow correction module 310 determines the correction factor adjustment value as describe above. The coolant flow correction module 310 then determines the coolant flow correction factor by subtracting the correction factor adjustment value from the previous value of the coolant flow correction factor.

At 408, the temperature correction module 312 determines whether coolant flowing through the cooling system of the vehicle system 100 is boiling. The temperature correction module 312 may determine whether the coolant is boiling based on the cooling input pressure measured by the CIP sensor 182 and the measured coolant temperature as described above. If coolant flowing through the cooling system is boiling, the method continues at 418 and then returns to 404. Otherwise, the method simply returns to 404.

At 418, the temperature correction module 312 adjusts (decreases) a difference between the coolant input temperature and the coolant output temperature. As discussed above, the desired coolant flow module 302 may determine use this difference between the coolant input temperature and the coolant output temperature, as adjusted, to determine the desired coolant flow rate.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. As used herein, the phrase at least one of A, B, and C should be construed to mean a logical (A OR B OR C), using a non-exclusive logical OR, and should not be construed to mean "at least one of A, at least one of B, and at least one of C." It should be understood that one or more steps within a method may be executed in different order (or concurrently) without altering the principles of the present disclosure.

In this application, including the definitions below, the term "module" or the term "controller" may be replaced with the term "circuit." The term "module" may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components that provide the described functionality; or a combination of some or all of the above, such as in a system-on-chip.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

The term code, as used above, may include software, firmware, and/or microcode, and may refer to programs, routines, functions, classes, data structures, and/or objects. The term shared processor circuit encompasses a single processor circuit that executes some or all code from multiple modules. The term group processor circuit encompasses a processor circuit that, in combination with additional processor circuits, executes some or all code from one or more modules. References to multiple processor circuits encompass multiple processor circuits on discrete dies, multiple processor circuits on a single die, multiple cores of a single processor circuit, multiple threads of a single processor circuit, or a combination of the above. The term shared memory circuit encompasses a single memory circuit that stores some or all code from multiple modules. The term group memory circuit encompasses a memory circuit that, in combination with additional memories, stores some or all code from one or more modules.

The term memory circuit is a subset of the term computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory, tangible computer-readable medium are nonvolatile memory circuits (such as a flash memory circuit, an erasable programmable read-only memory circuit, or a mask read-only memory circuit), volatile memory circuits (such as a static random access memory circuit or a dynamic random access memory circuit), magnetic storage media (such as an analog or digital magnetic tape or a hard disk drive), and optical storage media (such as a CD, a DVD, or a Blu-ray Disc).

The apparatuses and methods described in this application may be partially or fully implemented by a special purpose computer created by configuring a general purpose computer to execute one or more particular functions embodied in computer programs. The functional blocks, flowchart components, and other elements described above serve as software specifications, which can be translated into the computer programs by the routine work of a skilled technician or programmer.

The computer programs include processor-executable instructions that are stored on at least one non-transitory, tangible computer-readable medium. The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc.

The computer programs may include: (i) descriptive text to be parsed, such as HTML (hypertext markup language) or XML (extensible markup language), (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C#, Objective C, Haskell, Go, SQL, R, Lisp, Java®, Fortran, Perl, Pascal, Curl, OCaml, Javascript®, HTML5, Ada, ASP (active server pages), PHP, Scala, Eiffel, Smalltalk, Erlang, Ruby, Flash®, Visual Basic®, Lua, and Python®.

None of the elements recited in the claims are intended to be a means-plus-function element within the meaning of 35 U.S.C. § 112(f) unless an element is expressly recited using the phrase "means for," or in the case of a method claim using the phrases "operation for" or "step for."

What is claimed is:

1. A control system comprising:

an estimated coolant flow module that estimates a rate of coolant flow through a cooling system for an engine based on a pressure of coolant in the cooling system and a speed of a coolant pump that circulates coolant through the cooling system;

at least one of:

a valve control module that controls the position of a coolant valve based on the estimated coolant flow rate; and a pump control module that controls the coolant pump speed based on the estimated coolant flow rate;

a desired coolant flow module that:

determines a desired rate of coolant flow through the cooling system based on a temperature of coolant flowing through the cooling system; and adjusts the desired coolant flow rate based on the estimated coolant flow rate; and a temperature correction module that:

determines whether coolant flowing through the cooling system is boiling based on the coolant pressure and the coolant temperature;

determines a temperature correction factor based on whether coolant flowing through the cooling system is boiling; and adjusts the coolant temperature used to determine the desired coolant flow rate based on the temperature correction factor.

2. The control system of claim 1 further comprising a coolant pressure sensor that measures the coolant pressure.

3. The control system of claim 2 wherein the coolant pressure sensor measures the coolant pressure on an inlet side of the engine.

4. The control system of claim 1 wherein the at least one of the valve control module and the pump control module determine a target value for at least one of the coolant valve position and the coolant pump speed based on the desired coolant flow rate.

5. The control system of claim 1 wherein the desired coolant flow module: increases the desired coolant flow rate when the desired coolant flow rate is greater than the estimated coolant flow rate; and decreases the desired coolant flow rate when the desired coolant flow rate is less than or equal to the estimated coolant flow rate.

6. The control system of claim 1 further comprising a coolant flow correction module that determines a coolant flow correction factor based on a difference between the desired coolant flow rate and the estimated coolant flow rate, wherein the desired coolant flow module adjusts the desired coolant flow rate based on the coolant flow correction factor.

7. A control system comprising:

an estimated coolant flow module that estimates a rate of coolant flow through a cooling system for an engine based on a pressure of coolant in the cooling system and a speed of a coolant pump that circulates coolant through the cooling system;

at least one of:

a valve control module that controls the position of a coolant valve based on the estimated coolant flow rate; and a pump control module that controls the coolant pump speed based on the estimated coolant flow rate;

a desired coolant flow module that:

determines a desired rate of coolant flow through the cooling system based on a temperature of coolant flowing through the cooling system; and adjusts the desired coolant flow rate based on the estimated coolant flow rate; and a coolant flow correction module that determines a coolant flow correction factor based on a difference between the desired coolant flow rate and the estimated coolant flow rate, wherein the desired coolant flow module adjusts the desired coolant flow rate based on the coolant flow correction factor, wherein the coolant flow correction module:

determines a correction factor adjustment value based on the difference between the desired coolant flow rate and the estimated coolant flow rate; and determines the coolant flow correction factor based on the correction factor adjustment value and a previous value of the coolant flow correction factor.

8. A method comprising:

estimating a rate of coolant flow through a cooling system for an engine based on a pressure of coolant in the cooling system and a speed of a coolant pump that circulates coolant through the cooling system;

at least one of:

controlling the position of a coolant valve based on the estimated coolant flow rate; and controlling the coolant pump speed based on the estimated coolant flow rate;

determining a desired rate of coolant flow through the cooling system based on a temperature of coolant flowing through the cooling system;

determining a correction factor adjustment value based on a difference between the desired coolant flow rate and the estimated coolant flow rate;

determining a coolant flow correction factor based on the correction factor adjustment value and a previous value of the coolant flow correction factor; and adjusting the desired coolant flow rate based on the coolant flow correction factor.

9. The method of claim 8 further comprising measuring the coolant pressure.

10. The method of claim 9 further comprising measuring the coolant pressure on an inlet side of the engine.

11. The method of claim 8 further comprising determining a target value for at least one of the coolant valve position and the coolant pump speed based on the desired coolant flow rate.

12. The method of claim 8 further comprising: increasing the desired coolant flow rate when the desired coolant flow rate is greater than the estimated coolant flow rate; and decreasing the desired coolant flow rate when the desired coolant flow rate is less than or equal to the estimated coolant flow rate.

13. The method of claim 8 further comprising: determining whether coolant flowing through the cooling system is boiling based on the coolant pressure and the coolant temperature; and adjusting the coolant temperature used to determine the desired coolant flow rate based on whether coolant flowing through the cooling system is boiling.

14. The method of claim 13 further comprising:

determining a temperature correction factor based on whether coolant flowing through the cooling system is boiling; and adjusting the coolant temperature based on the temperature correction factor.

* * * * *